US007230196B2

(12) United States Patent
Toyama

(10) Patent No.: US 7,230,196 B2
(45) Date of Patent: Jun. 12, 2007

(54) LIGHTED SWITCH DEVICE

(75) Inventor: Yasunori Toyama, Fujiyoshida (JP)

(73) Assignees: Citizen Electronics Co., Ltd., Yamanashi (JP); Alpha Corporation, Kanagawa (JP)

( * ) Notice: Subject to any disclaimer, the term of this patent is extended or adjusted under 35 U.S.C. 154(b) by 0 days.

(21) Appl. No.: 11/235,151

(22) Filed: Sep. 27, 2005

(65) Prior Publication Data

US 2006/0065514 A1 Mar. 30, 2006

(30) Foreign Application Priority Data

Sep. 27, 2004 (JP) ..... 2004-280751

(51) Int. Cl.
*H01H 9/00* (2006.01)

(52) U.S. Cl. ..... 200/314; 200/341

(58) Field of Classification Search ..... 200/310–314, 200/341–345, 293

See application file for complete search history.

(56) References Cited

U.S. PATENT DOCUMENTS 6,723,936 B2 * 4/2004 Ootsuka et al. ..... 200/517
6,930,263 B2 * 8/2005 Hung ..... 200/61.62
6,984,797 B2 * 1/2006 Morita et al. ..... 200/314
6,997,572 B2 * 2/2006 Ono et al. ..... 362/24
7,041,922 B2 * 5/2006 Geiger et al. ..... 200/296
2003/0226745 A1 * 12/2003 Sato et al. ..... 200/5 R
2004/0008505 A1 1/2004 Chiang
2005/0183305 A1 * 8/2005 Hirata et al. ..... 40/615

FOREIGN PATENT DOCUMENTS

EP 0 933 792 A1 8/1999
EP 1 389 788 A1 2/2004
JP 62-137972 U 8/1987
JP 2004-146260 A 5/2004

* cited by examiner

*Primary Examiner*—Michael Friedhofer
*Assistant Examiner*—Lisa Klaus
(74) *Attorney, Agent, or Firm*—Browdy and Neimark, PLLC

(57) ABSTRACT

A lighted switch device, comprising a substrate, a switch provided on a first surface of the substrate, a light source provided on a second surface of the substrate, a key top to press the switch, and a light guide mechanism to guide light emitted from the light source to the key top or a periphery of the key top, the light guide mechanism including a first light guiding member to hold the key top and a second light guiding member disposed to surround the light source, the light emitted from the light source being guided through the second light guiding member to the first light guiding member holding the key top.

15 Claims, 2 Drawing Sheets

LIGHTED SWITCH DEVICE

CROSS-REFERENCE TO THE RELATED APPLICATION

This application is based on and claims priority from Japanese Patent Application No. 2004-280751 filed on Sep. 27, 2004, the disclosure of which is incorporated herein by reference in its entirety.

BACKGROUND OF THE INVENTION

1. Field of the Invention

The present invention relates to a lighted switch device used in in-car instruments, electric home appliances, front doors or equipments and apparatus expected to be used in darkness.

2. Description of Related Art

One known conventional lighted switch device used in meters of automobiles includes a press button, a lighting part provided on the press button, and a plurality of LEDs disposed on a wiring board, and the device is configured to guide light emitted from the LEDs through the lighting part to an emission surface provided on a top portion of the press button (for reference, see Japanese Patent Laid-Open No.2004-146260, FIG. 3 and paragraphs 0016 to 0022).

Also known is a keyhole illumination device including a light guide disposed at a periphery of a keyhole and a light source provided on a side surface or lower surface of the light guide and used in an ignition key of a vehicle; the device is configured to illuminate the periphery of the keyhole through the light guide by light emitted from the light source (for reference, see Japanese Utility Model Laid-Open No.S62-137972, FIG. 1 and page1).

However, in the lighted switch structure as described in Japanese Patent Laid-Open No.2004-146260, because the distance from the LEDs to the emission surface is relatively short, it is difficult to diffuse the light towards the emission surface, and hence the emission surface tends to be one spot illumination. Conversely, if a light diffusion material is introduced in the lighting part to achieve increased light diffusion efficiency, there is a problem that the amount of light emission is reduced.

Furthermore, in the keyhole illumination device as described in Japanese Utility Model Laid-Open No.S62-137972, the device is structured to indicate the position of the keyhole in darkness, however, there is a problem that the light becomes non-uniform in the light guide, because the light source is attached to a portion of the light guide. Therefore, in this device, the structure makes it difficult for light emitted from the light source to go round to the opposite side of the light source.

SUMMARY OF THE INVENTION

An object of the present invention is to provide a lighted switch device capable of uniformly illuminating a key top or a periphery thereof so that the key top position can be recognized even in darkness.

To accomplish the above-mentioned object, a lighted switch device according to one embodiment of the present invention comprises a substrate, a switch provided on a first surface of the substrate, a light source provided on a second surface of the substrate, a key top to press the switch, and a light guide mechanism to guide light emitted from the light source to the key top or a periphery of the key top.

The light guide mechanism includes a first light guiding member to hold the key top and a second light guiding member disposed to cover the light source. The light emitted from the light source is guided through the second light guiding member to the first light guiding member.

With this structure, the key top or the periphery thereof can be uniformly illuminated.

In one embodiment, the first and second light guiding members are made of transparent or translucent resin. In addition, at least one light diffusion material is contained in the first light guiding member or at least one light diffusion treatment such as undulations or the like is applied to a surface of the first light guiding member.

DETAILED DESCRIPTION OF THE PREFERRED EMBODIMENTS

Preferred embodiments of the present invention will be explained in detail with reference to the accompanying drawings below.

Figure 1:
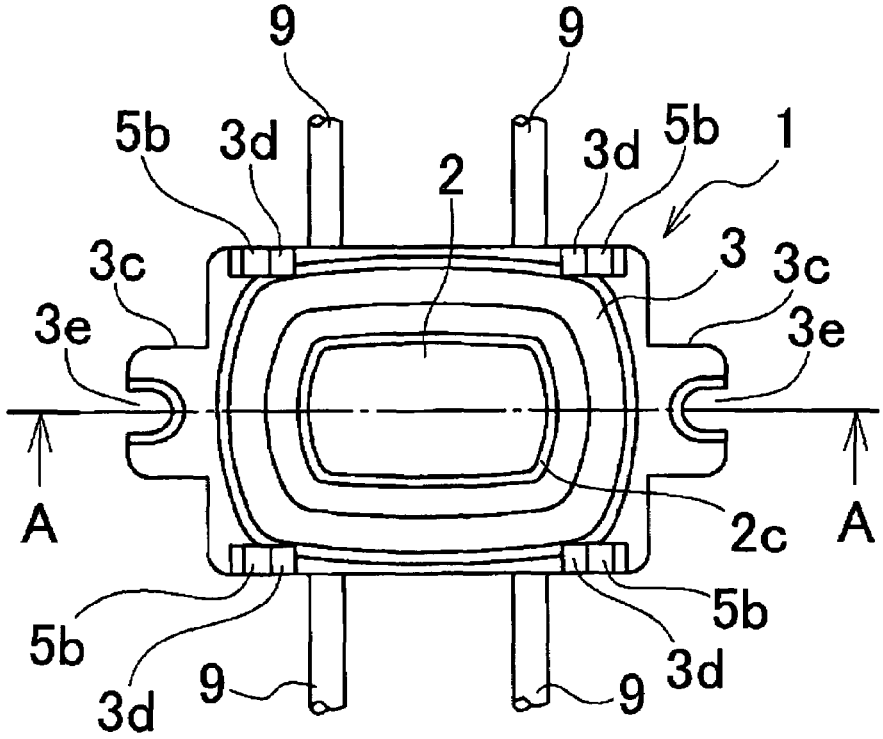
FIG. 1 is a top plan view of a lighted switch device according to one embodiment of the present invention.
Figure 2:
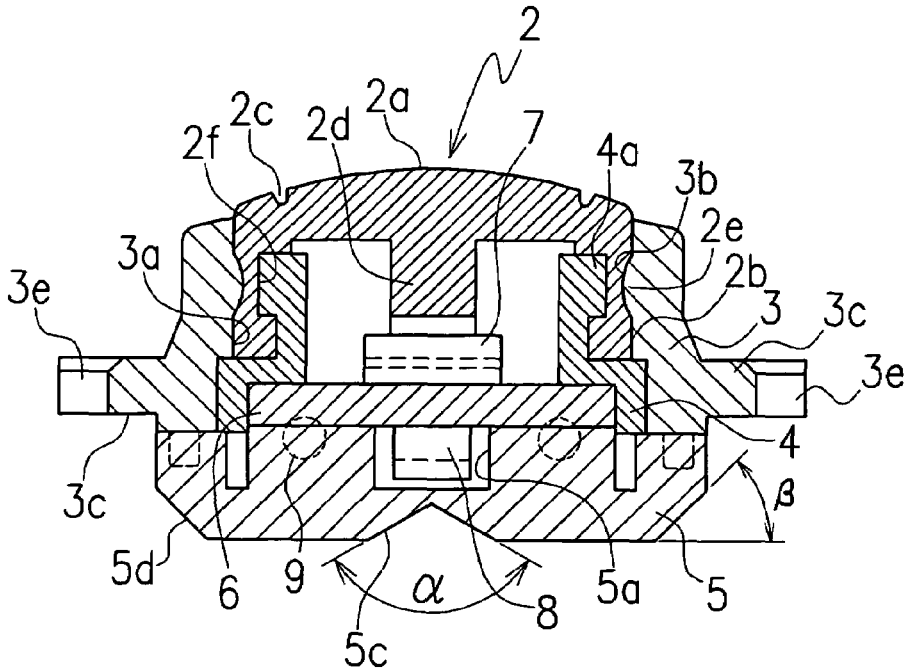
FIG. 2 is a sectional view taken along line A—A in FIG. 1.
Figure 3:
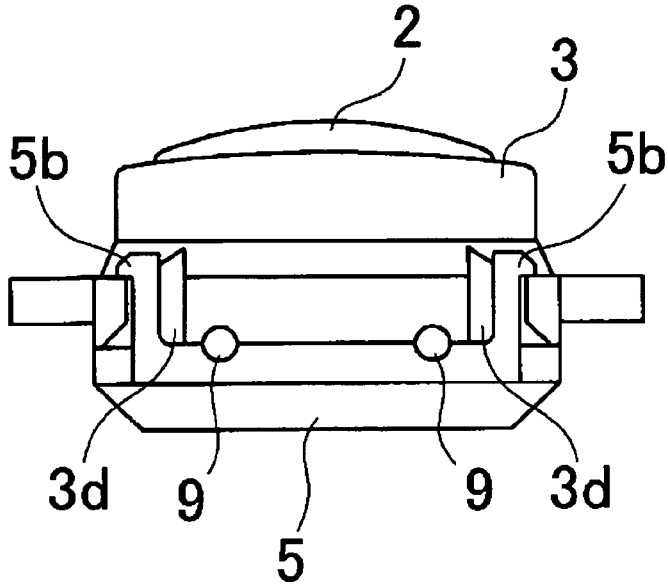
FIG. 3 is a front view of the lighted switch device shown in FIG. 1.
Figure 4:
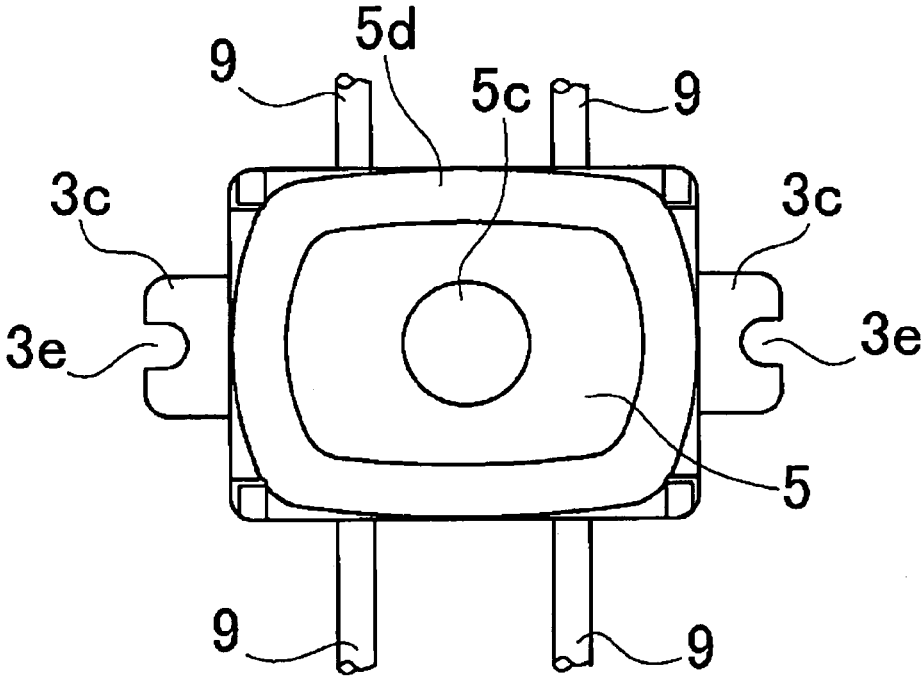
FIG. 4 is a bottom view of the lighted switch device shown in FIG. 1.

FIGS. 1 to 4 illustrate one embodiment of a lighted switch device 1 according to the present invention. The lighted switch device 1 includes a substrate 6, as shown in FIG. 2. A switch 7 is disposed on a first surface, for example, an upper surface, of the substrate 6 and a light source, for example, an LED 8 is disposed on a second surface, for example, a lower surface of the substrate 6 (see FIG. 2). The switch 7 is attached to a central wiring pattern (not shown) provided on the upper surface of the substrate 6 and the LED 8 is attached to a central wiring pattern (not shown) provided on the lower surface of the substrate 6. The switch 7 and the LED 8 are disposed on a central axis of the lighted switch device 1 A key top 2 is disposed above the switch 7 to operate the switch 7. The key top 2 is made of a resilient material such as silicon, for example. The key top 2 is formed of a generally rectangular cylinder having a smoothly curved upper wall 2*a* and a side wall 2*b* extending from the upper wall 2*a* (see FIGS. 1 and 2). The key top 2 also has a groove 2*c* provided along a peripheral edge of the upper surface or an outside surface of the upper wall 2*a* and a pillar part 2*d* provided on the central axis of the lighted switch device 1 to extend toward the switch 7 (see FIGS. 1 and 2). As a result, light emitted from the LED 8 can illuminate around the key top 2 uniformly.

A first light guiding member 3 is provided to surround the key top 2. The first light guiding member 3 in the illustrated embodiment comprises a cylindrical light guiding frame made of transparent or translucent resin containing at least one light diffusion material. Also, at least one light diffusion treatment such as undulations or the like may be applied to a surface of the light guiding frame 3 instead of including the light diffusion material in the light guiding frame 3. The side wall 2*b* of the key top 2 is inserted in a central hole 3*a* provided in the light guiding frame 3. An outside surface of the side wall 2*b* of the key top 2 is provided with a concave portion 2*e*, and a convex portion 3*b* to engage with the concave portion 2*e* is provided in the central hole 3*a* of the light guiding frame 3. Thereby, the key top 2 is not easily disengaged from the light guiding frame 3.

The light guiding frame 3 also has a flange 3*c*, as shown in FIG. 1. The flange 3*c* includes a plurality of cutouts 3*d* and at least two semi-circular mounting holes 3*e* for attaching the lighted switch device 1 to any chosen position.

A holding frame 4 is provided on an inner surface of the side wall 2*b* of the key top 2, as shown in FIG. 2. The holding frame 4 acts to hold the key top 2 from inside, and the key top 2 is held between the holding frame 4 and the light guiding frame 3. The holding frame 4 has an upper part which is inserted in the side wall 2*b* of the key top 2 and a lower part which is mounted on the substrate 6. A concave portion 2*f* is provided in the inner surface of the side wall 2*a* of the key top 2 and a convex portion 4*a* fitting in the concave portion 2*f* is provided in the upper part of the holding frame 4. It is preferable that the convex portion 4*a* be provided at a position facing the convex portion 3*b* of the light guiding frame 3. In this way, the side wall 2*b* of the key top 2 is held by the convex portion 4*a* of the holding frame 4 and the convex portion 3*b* of the light guiding frame 3 facing the convex portion 4*a*.

A second light guiding member 5 is disposed on the lower surface of the substrate 6 to cover the LED 8 (see FIG. 2). The second light guiding member 5 comprises a light guiding cap made of a transparent resin. The light guiding cap 5 has a concave portion 5*a* which is provided in a central portion of an upper surface of the light guiding cap 5. The LED 8 is disposed in the concave portion 5*a*.

The light guiding cap 5 also has hook portions 5*b* (see FIG. 1) extending from four corners on the upper part and a light reflecting part. The light reflecting part includes a conical concave portion 5*c* formed on a central portion of a lower surface of the light guiding cap 5 to face the concave portion 5*a*, and an inclined surface 5*d* formed on an outer periphery of the light guiding cap 5 (see FIG. 2). The light guiding cap 5 is securely connected to the light guiding frame 3 by snap-engaging or snap-fitting the hook portions 5*b* in the cutouts 3*d* of the light guiding frame 3. At this time, the key top 2 is securely held between the light guiding frame 3 and the holding frame 4, as described above, and the substrate 6 is also held between the light guiding cap 5 and the holding frame 4.

The light guiding frame 3 and the light guiding cap 5 are sealed at a jointed part thereof at a periphery of the substrate 6 by transparent or translucent resin (not shown) such as an epoxy type resin. Because the key top 2 and the light guiding frame 3 are in close contact as described above and the joint part of the light guiding frame 3 and the light guiding cap 5 is sealed by the transparent or translucent resin, the lighted switch device 1 has a waterproof structure.

In this embodiment, the LED 8 which is a single package comprising a blue LED element to emit white light is mounted on the central wiring pattern on the lower surface of the substrate 6.

Light emitted from the LED 8 is reflected on the conical concave portion 5*c* and the inclined surface 5*d* of the light guiding cap 5, as described hereinafter. As shown in FIG. 2, by suitably selecting an apex angle $\alpha$ of the conical concave portion 5*c* and an oblique angle $\beta$ of the inclined surface 5*d*, the light emitted from the LED 8 is now transmitted to the light guiding frame 3, preventing light emission from the light guiding cap 5. Further, it is found in one embodiment that the optimum value of $\alpha$ lies in the range of 90° to 150° and the optimum value of $\beta$ lies in the range of 60° to 120°.

A plurality of lead wires 9 are connected to the wiring patterns which provide electrical contacts to the switch 7 and the LED 8 disposed on the substrate 6. It is desirable that the plurality of lead wires 9 are extended from the substrate 6 through a boundary surface of the light guiding frame 3 and the light guiding cap 5 to the outside of the lighted switch device. Preferably, the lead wires 9 are extended to the outside of the lighted switch device, disposed to have as much space as possible between each other. In one embodiment according to the present invention, respective two lead wires 9 are extended from both opposite surfaces of the lighted switch device 1 and the respective two lead wires 9 are disposed to have space between each other. The end of each of the lead wires 9 extended to the outside of the lighted switch device is connected to an external electric circuit (not shown).

Next, the condition of the lighted switch device in use is explained with relation to the embodiment described above.

The LED 8 is lighted by applying a current to the LED 8 through the lead wires 9. Light emitted from the LED 8 is dispersed in all directions by the conical concave portion 5*c* of the light guiding cap 5 and reflected on the inclined surface 5*d*, then directed to enter the upwardly disposed light guiding frame 3. The light which enters and passes through the light guiding frame 3 is dispersed in the light guiding frame 3 to uniformly illuminate the key top 2 and the illuminating light around the key top 2 appears to be in a generally ring-like state here. Accordingly, it is possible to operate the key by pressing the key top which is uniformly illuminated by the light, even in darkness. When the key top 2 is pressed to operate the key, the key top 2 is resiliently deformed in a downward direction and the pillar portion 2*d* presses the switch 7, thereby the switch 7 is turned on and the electric circuit which is connected to the switch 7 through the lead wires 9 is operated.

Furthermore, in the above-mentioned embodiment, the key top 2 is made of a resilient material and a groove 2*c* provided on the peripheral edge portion of the upper surface of the key top 2, so that these configurations make the upward and downward deformation of the key top easy. The light emitted from the LED can be dispersed in all directions by the conical concave portion 5*c* even though only a single package comprising a blue LED element to emit white light is used as the light source. Moreover, the light dispersed by the conical concave portion is reflected on the inclined surface 5*d* and then directed to enter the upwardly disposed light guiding frame 3. Light which enters the light guiding frame 3 is transmitted and dispersed efficiently, because at least one light diffusion material is contained in the transparent or translucent light guiding frame 3. As a result, light transmitted and dispersed through the light guiding frame 3 illuminates the area around the key top uniformly.

A blue LED element used here in a single package as the light source is generally expensive, however, in an embodiment according to the present invention, even a single package comprising a single LED element is sufficient to illuminate the key top, because light emitted from the LED element is used effectively. Consequently, the configurations according to the present invention enable provision of inexpensive lighted switch devices.

The lighted switch device 1 can be recognized even in darkness because of the uniformly illuminated key top or key position. Furthermore, it has a waterproof structure. Therefore, lighted switch devices according to the present invention can be applied to any apparatus and equipment provided outside, for example, any switches provided on a vehicle. Because the lead wires 9 are extended from the substrate 6, being disposed to extend laterally from the lighted switch device, the light transmission from the light source to the key top is not disturbed by the lead wires. In addition, the light transmission is not blocked because a transparent or translucent resin is used for the jointed surface of the light guiding frame 3 and the light guiding cap 5. Moreover, because the switch 7 and the LED 8 can be easily exchanged depending on conditions or requirements, it is possible to respond quickly to the user's demands. Furthermore, because the main parts of the lighted switch devices according to the present invention can be produced inexpensively by a resinous forming technology, cost reduction can be achieved.

According to the present invention, the key top and the area around it are uniformly illuminated and the key position can be recognized even in darkness, as mentioned above. Moreover, it is possible to provide a lighted switch device having good functionality and design properties by selecting a suitable light source without cost increase.

In addition, the present invention is not necessarily limited to the above-mentioned embodiment. For example, cutouts may be provided on the light guiding cap 5 and hook portions may be provided on the light guiding frame 3 to allow snap-fitting engagement between the light guiding frame 3 and the light guiding cap 5.

Moreover, the first and second light guiding members may be welded or formed integrally. In this case, an easily assembled lighted switch device may be provided merely by making slight changes to the shape of portions of the parts. The light source is not limited to an LED package comprising a blue LED element; other LED packages, for example, unicolor LED packages, or multicolor LED packages comprising at least one LED element, fluorescent materials and/or dye stuff, may be used as the light source. Moreover, a plurality of LED elements having different colors, for example, Red (R), Green (G) and Blue (B) may be packaged in one. In these cases, the emission color can be changed to suit the purpose. Furthermore, the brightness of the light source can be intensified by using an increased number of LED elements. In the above embodiment, a lamp instead of an LED package or element may be used as the light source.

In addition, the light emitted from the LED as a light source and transmitted through the light guiding cap 5 to the key top 2 can be efficiently prevented from being emitted from the light guiding cap 5 by providing a reflecting layer on an outside surface of the light guiding cap 5 excluding the upper surfaces comprising the upper surface which faces the light source and the upper surface which is joined to the light guiding frame 3. The reflecting layer can be formed by, for example, plating, spattering, deposition, or painting. For a good design a plated plastic plate may be attached to the upper surface of the key top to achieve a glossy metallic appearance. Also, the light source may be provided on the substrate's upper surface which is the same side on which the switch to illuminate the key top is located. In this case, the key top is made of transparent or translucent material.

The lighted switch devices according to the present invention can be applied to automobiles, in-car instruments, electric home appliances, front doors or equipments and apparatus expected to be used in darkness.

What is claimed is:

1. A lighted switch device, comprising:

a substrate;

a switch provided on a first surface of the substrate;

a light source provided on a second surface of the substrate;

a key top provided above the switch; and a light guide mechanism provided adjacent to the key top, wherein the light guide mechanism comprises a first light guiding member to surround and hold the key top in place and a second light guiding member disposed to cover the light source, and wherein the light emitted from the light source is guided through the second light guiding member to the first light guiding member disposed to surround the key top.

2. The lighted switch device according to claim 1, wherein each of the first and second guiding members is made of transparent resin.

3. The lighted switch device according to claim 2, wherein at least one light diffusion material is contained in the first light guiding member.

4. The lighted switch device according to claim 2, wherein at least one light diffusion treatment is applied to a surface of the first light guiding member.

5. The lighted switch device according to claim 2, wherein the first and second light guiding members are jointed to each other.

6. The lighted switch device according to claim 1, wherein the second light guiding member has at least one light reflecting part to reflect light emitted from the light source.

7. The lighted switch device according to claim 6, wherein the light reflecting part includes a conical concave portion provided on a central portion of a lower surface of the second light guiding member and an inclined surface provided on an outer periphery of the lower surface of the second light guiding member.

8. The lighted switch device according to claim 1, wherein one of the first and second light guiding members includes a plurality of hook portions and the other includes a plurality of cutouts, and wherein the first and second light guiding members are jointed by engaging the hook portions and the cutouts.

9. The lighted switch device according to claim 1, wherein the switch and the light source are mounted on wiring patterns disposed on the first and second surfaces of the substrate, wherein lead wires are extended from the wiring patterns to outside of the lighted switch device, and wherein the lead wires extended to outside of the lighted switch device are disposed to have space between each other.

10. The lighted switch device according to claim 1, wherein a reflecting layer is provided on an outside surface of the second light guiding member excluding upper surfaces.

11. The lighted switch device according to claim 10, wherein the reflecting layer is formed by a way selected from plating, deposition, spattering, and painting.

12. The lighted switch device according to claim 1, further comprising a holding frame disposed in the key top, wherein the key top is held by the holding frame and the first light guiding member.

13. The lighted switch device according to claim 1, wherein the first and second light guiding members are integrally formed.

14. The lighted switch device according to claim 1, wherein the key top is made of a resilient resin, and wherein a groove is provided on an outside surface of the key top.

15. The lighted switch device according to claim 1, wherein the light source is electrically connected to the switch and the key top is configured to activate the switch so that when the switch is activated by the key top, the light source emits light.

* * * * *